US006525458B1

(12) United States Patent
Muraguchi et al.

(10) Patent No.: US 6,525,458 B1
(45) Date of Patent: Feb. 25, 2003

(54) COLOR SELECTING MEMBER METHOD OF PREVENTING VIBRATION OF COLOR SELECTING MEMBER AND CATHODE RAY TUBE

(75) Inventors: Shoichi Muraguchi, Kanagawa (JP); Masamichi Okada, Kanagawa (JP)

(73) Assignee: Sony Corporation (JP)

( * ) Notice: Subject to any disclaimer, the term of this patent is extended or adjusted under 35 U.S.C. 154(b) by 295 days.

(21) Appl. No.: 09/593,491

(22) Filed: Jun. 14, 2000

(30) Foreign Application Priority Data

Jun. 15, 1999 (JP) ..... 11-168633

(51) Int. Cl.[7] ..... H01J 1/18; H01J 29/80; H01J 29/10

(52) U.S. Cl. ..... 313/408; 313/269; 313/461; 313/402

(58) Field of Search ..... 313/402, 403, 313/404, 405, 406, 407, 408, 409, 412, 413, 415, 461, 269, 463

(56) References Cited

U.S. PATENT DOCUMENTS 4,780,641 A * 10/1988 Hashiba et al. ..... 313/269
4,792,720 A * 12/1988 Takenaka et al. ..... 313/402
5,365,143 A * 11/1994 Nishimura et al. ..... 313/402
5,382,871 A * 1/1995 Funahashi et al. ..... 313/269
5,525,859 A * 6/1996 Ito et al. ..... 313/402

OTHER PUBLICATIONS

"The Camel CRT: ISSN0098–0966X/2901/1998–SID" announced by A.A.S. Sluyterman (Philips Components).

* cited by examiner

*Primary Examiner*—Nimeshkumar D. Patel
*Assistant Examiner*—Karabi Guharay
(74) *Attorney, Agent, or Firm*—Rader, Fishman & Grauer PLLC; Ronald P. Kananen, Esq.

(57) ABSTRACT

A technique is described for lightening a shadow of a damper line for preventing vibration of a color selecting member cast on a video screen and further preventing occurrence of the shadow. In a cathode ray tube in which electron beams emitted from neighboring electron guns cross each other before passing through a plurality of apertures of a color selecting member and has an area through which both of the electron beams pass. A damper line is provided in the area through which both of the electron beams pass. Since one of the electron beam falls on a shadow cast by the other electron beam, the shadow becomes lighter.

6 Claims, 6 Drawing Sheets

COLOR SELECTING MEMBER METHOD OF PREVENTING VIBRATION OF COLOR SELECTING MEMBER AND CATHODE RAY TUBE

BACKGROUND OF THE INVENTION

1. Field of the Invention

The present invention relates to a color selecting member in which a damper line for preventing vibration is provided in a tensioned state, a method of preventing vibration of the color selecting member, and a cathode ray tube having such a color selecting member.

2. Description of the Related Art

In a cathode ray tube, a color selecting member is provided for selecting an electron beam emitted from an electron gun, irradiating the selected electron beams only on phosphors of red, blue and green, respectively, and for projecting a video image according to each color onto a fluorescent screen.

FIG. 1 shows an example of the structure of a conventional color selecting member. The color selecting member 11 is what is called an aperture grille and is provided between a pair of frame members 13 under predetermined tension. A pair of arm members 12 are provided across both ends of the pair of frame members 13.

The color selecting member 11 is constructed by a metal thin plate and has: a number of striped apertures 14 which are arranged at a predetermined pitch and through which an electron beam passes; and linear electrodes 15 each of which has a string structure and is provided between neighboring apertures 14. The color selecting member 11 performs color selecting according to an incident angle of an electron beam entering the apertures 14.

In such a color selecting member 11, it is necessary to prevent occurrence of resonance due to vibration from the outside such as vibration caused by sound from a speaker, vibration caused during transportation between facilities at the time of manufacture of a fluorescent screen, and the like. Hitherto, the color selecting member 11 is therefore provided with two damper lines 16 constructed by thin metal lines which are in contact with the surface of the color selecting member 11 and are orthogonal to the linear electrodes 15 and apertures 14. Both ends of each of the damper lines 16 are attached to damper springs 17 provided for the arm members 12 under predetermined tension.

In the cathode ray tube using the conventional color selecting member 11, however, electron beams emitted from the electron gun are interrupted by the damper lines 16 which extend across the apertures 14 of the color selecting member 11. It causes a problem such that the electron beams do not hit the phosphors on the fluorescent screen sufficiently, a shadow of each of the damper lines 16 is cast on a video screen and, as a result, the quality of the video image deteriorates.

It can be considered that the shadow of the damper line 16 on the video screen is made inconspicuous by reducing the diameter of the damper line 16. In this case, however, since the strength at break of the damper line 16 deteriorates, the tension to press the surface of the color selecting member 11 has to be weakened. As a result, a problem lowering the effect of attenuating the vibration of the color selecting member 11 occurs.

Meanwhile, in recent years, in order to enlarge the screen while reducing the depth, a multiple electron gun type cathode ray tube having a plurality of electron guns has been developed. In such a multiple electron gun type cathode ray tube, as the screen becomes larger, the shadow of the damper line cast on the video screen becomes larger and more conspicuous.

SUMMARY OF THE INVENTION

The present invention was achieved in consideration of the problems with the aim of providing a color selecting member in which a shadow of a damper line cast on a video screen is made inconspicuous or the occurrence of a shadow is suppressed and yet whose vibration can be effectively prevented in a cathode ray tube having a plurality of electron guns, a method of preventing the vibration of the color selecting member, and a cathode ray tube having such a color selecting member.

A color selecting member according to the invention is used for a cathode ray tube having a plurality of electron guns and has a construction that a damper line for preventing vibration is provided in a tensioned state in a position opposite to an area on a fluorescent screen, which is irradiated with both electron beams emitted from neighboring electron guns. More specifically, when the color selecting member is used for a cathode ray tube in which electron beams emitted from neighboring electron guns cross each other before passing through a plurality of apertures, the damper line is provided in a tensioned state in an area through which both of the electron beams pass. When the color selecting member is used for a cathode ray tube in which electron beams emitted from neighboring electron guns cross each other after passing through the plurality of apertures, the damper line is provided in a tensioned state in an area through which both of the electron beams do not pass.

In a method of preventing vibration of a color selecting member according to the invention, a damper line is selectively provided in a tensioned state in a position opposite to an area on the fluorescent screen, the area being irradiated with both of the electron beams emitted from the neighboring electron guns, in accordance with whether the electron beams emitted from the neighboring electron guns cross each other before or after passing through the plurality of apertures.

Further, the cathode ray tube according to the invention has a color selecting member as described above.

In the color selecting member, the method of preventing vibration of the color selecting member, and the cathode ray tube according to the invention, since the damper line is provided in a tensioned state on an area of the color selecting member, which is opposite to the area on the fluorescent screen irradiated with both electron beams emitted from neighboring electron guns, a shadow of the damper line cast on the fluorescent screen can be lightened or prevented. That is, in the cathode ray tube in which the electron beams emitted from the neighboring electron guns cross each other before passing through the plurality of apertures, even when a shadow of the damper line is cast on the fluorescent screen by one of the electron beams, the other electron beam falls on the shadow, thereby lightening the shadow. In the cathode ray tube in which the electron beams emitted from the neighboring electron guns cross each other after passing through the plurality of apertures, neither of the electron beams hits the damper line, so that the shadow of the damper line is not cast.

Other and further objects, features and advantages of the invention will appear more fully from the following description.

DETAILED DESCRIPTION OF THE PREFERRED EMBODIMENTS

Figure 1:
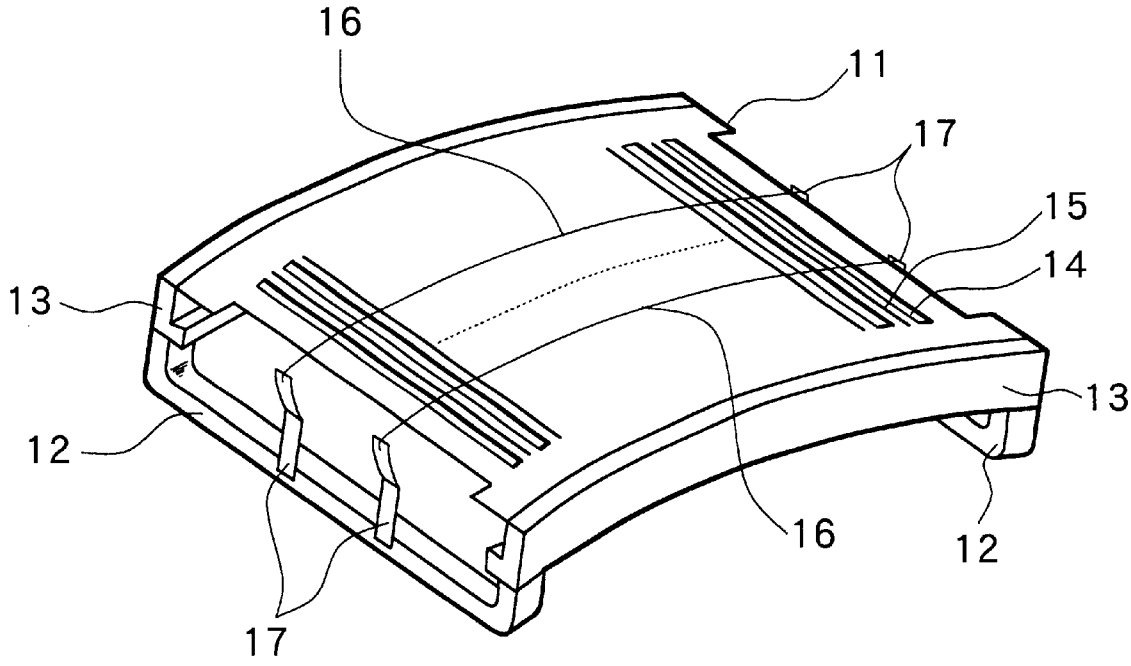
FIG.1 RELATED ART
FIG. 1 is a perspective view showing the construction of a color selecting member in a related art.

Embodiments of the invention will be described in detail hereinbelow by referring to the drawings.

[First Embodiment]

Figure 2:
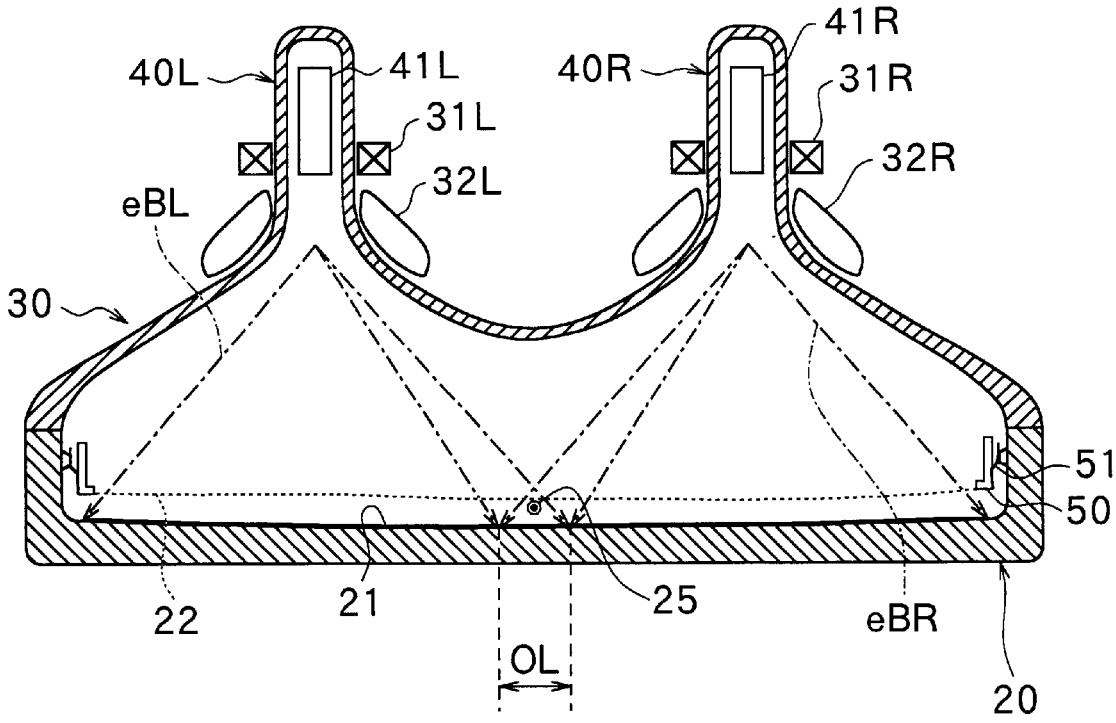
FIG. 2 is a cross section showing a schematic construction of a cathode ray tube having a color selecting member according to a first embodiment of the invention.
Figure 3:
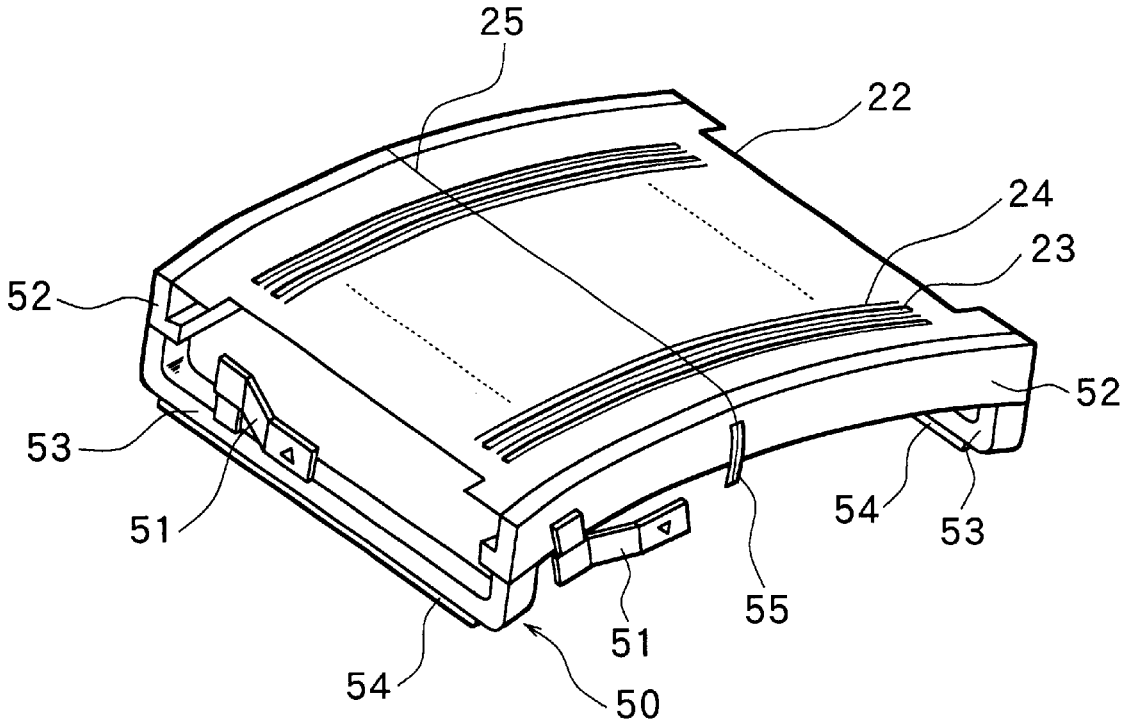
FIG. 3 is a perspective view showing the construction of the color selecting member in the cathode ray tube shown in FIG. 2.

FIG. 2 is a cross section of a cathode ray tube having a color selecting member according to a first embodiment of the invention. FIG. 3 shows the construction of the color selecting member of the cathode ray tube of FIG. 2. The cathode ray tube comprises: a panel 20 in which a fluorescent screen 21 is formed; and a funnel 30 integral with the panel 20. Two elongated necks 40R and 40L having therein electron guns 41R and 41L are formed at the right and left rear ends of the funnel 30, thereby obtaining a multiple electron gun type cathode ray tube. The cathode ray tube has an appearance of two funnels as a whole formed by panel 20, funnel 30 and necks 40R and 40L. In the fluorescent screen 21, for example, a pattern (not shown) of horizontal stripes constructed by phosphors is formed.

On the inside of the panel 20, a color selecting member 22 constructed by a metal thin plate is disposed so as to face the fluorescent screen 21. The color selecting member 22 is an aperture grille and has a number of apertures 23 which are formed in horizontal stripes in correspondence with the pattern of phosphors on the fluorescent screen 21 and through which electron beams eBR and eBL emitted from the electron guns 41R and 41L pass; and linear electrodes 24 each having a string shape and is disposed between neighboring apertures 23. The color selecting member 22 is supported by a metal supporting member 50 so that the distance between the color selecting member 22 and the fluorescent screen 21 is constant, and is attached to the inner face of the panel 20 via a resilient supporting member 51.

The supporting member 50 has a pair of facing frame members 52 to which the color selecting member 22 is welded under predetermined tension; and a pair of arm members 53 provided across both ends of the pair of frame members 52. A temperature change adjusting member (self-thermo control) 54 made by a rectangular metal thin plate is welded to each of the arm members 53.

The color selecting member 22 is provided with a damper line 25 constructed by a metal line or the like which is in contact with the surface of the color selecting member 22 and to which predetermined tension is applied in the direction almost orthogonal to the apertures 23 in horizontal stripes and the linear electrodes 24. By the damper line 25, vibration from the outside to the color selecting member 22 is prevented. The damper line 25 is stretched between damper springs 55 which are attached to the pair of facing frame members 53. The damper line 25 is made of tungsten, stainless steel, inconel, or the like. The diameter of the damper line 25 is, for example, about 20 to 22 $\mu$m. The setting position of the damper line 25 on the color selecting member 22 will be described herein later.

Although not shown, each of the electron guns 41R and 41L has a construction that a plurality of electrodes (grids) are arranged in front of a hot cathode structure having three cathodes (hot cathodes) for red, green and blue. In each of the electrodes, control, acceleration and the like are performed on the electron beams eBR and eBL emitted from the cathodes. The electron beams for respective colors emitted from the electron guns 41R and 41L are converged by convergence yokes 31R and 31L, deflected by deflection yokes 32R and 32L, pass through the apertures 23 in the color selecting member 22, respectively, and hit the phosphors of the corresponding colors of the fluorescent screen 21.

About left half of an image is drawn by the electron beams eBL emitted from the electron gun 41L disposed on the left side and about right half of the image is drawn by the electron beams eBR emitted from the electron gun 31R disposed on the right side. By partially overlapping and connecting the ends of the right and left partial images, a single image as a whole is formed and displayed. The central part of the image formed as a whole corresponds to an area OL in which the right and left partial images are overlapped with each other. The fluorescent screen 21 in the overlapping area OL is irradiated with the electron beams eBL and eBR.

The position on the color selecting member 22 of the damper line 25 will now be described.

In the case of the cathode ray tube having the plurality of electron guns 41R and 41L, whether the electron beams eBR and eBL emitted from the neighboring electron guns 41R and 41L cross each other before passing through the aperture 23 in the color selecting member 22 (an area both the electron beams eBR and eBL pass is generated in the aperture 23 in the color selecting member 22) or the electron beams eBR and eBL cross each other only after passing through the aperture 23 in the color selecting member 22 (an area both the electron beams do not pass is generated) is determined by the distance between each of the electron guns 41R and 41L and the color selecting member 22, the distance between the electron guns 41R and 41L, and the like. The former case relates to the first embodiment of the invention and the latter case relates to the second embodiment of the invention to be described later.

Figure 4:
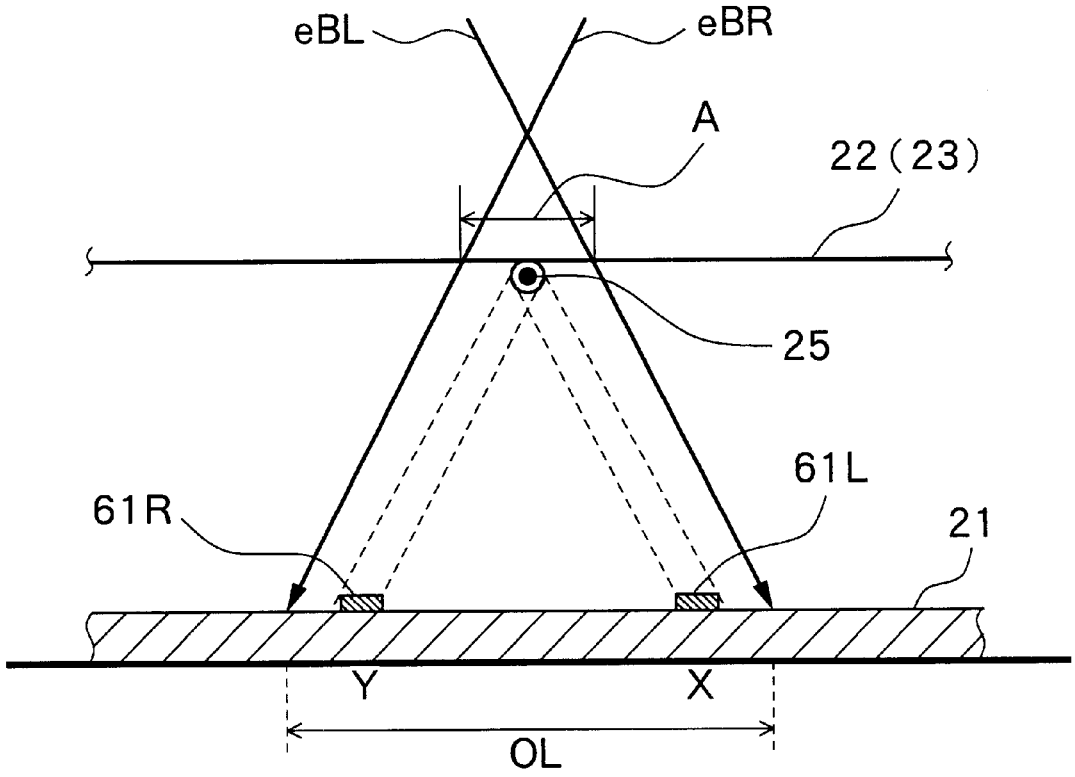
FIG. 4 is a diagram for explaining a setting position of a damper line in a case where electron beams cross each other before passing through an aperture in the color selecting member in the cathode ray tube shown in FIG. 2.

FIG. 4 shows the first embodiment and illustrates the setting position of the damper line 25 in the case where the electron beams eBR and eBL emitted from the electron guns 41R and 41L cross each other before passing through the aperture 23 in the color selecting member 22 (that is, an area both the electron beams eBR and eBL pass is generated in the aperture 23 in the color selecting member 22). The diagram shows the construction of a part of the cathode ray tube around the overlapping area OL in the first embodiment. The electron beam eBR from the electron gun 41R and the electron beam eBL from the electron gun 41L cross each other before passing through the aperture 23 in the color selecting member 22. Both the electron beams eBR and eBL pass through the area A in the aperture 23 in the color selecting member 22 when a line scan is performed. That is, the area A in the aperture 23 denotes an area through which both the electron beams eBR and eBL pass and is in a position facing the overlapping area OL. In the embodiment, the damper line 25 is provided on the area A in the aperture 23.

When the damper line 25 is provided on the area A in the aperture 23, the electron beam eBR hits the damper line 25 and a shadow 61R is cast on the overlapping area OL and the electron beam eBL hits the damper line 25 and a shadow 61L is cast on the overlapping area OL. However, the electron beam eBR used in the line scan falls on the shadow 61L, so that the shadow 61L becomes inconspicuous. The electron beam eBL used in the line scan falls on the shadow 61R, so that the shadow 61R becomes inconspicuous.

Figure 5:
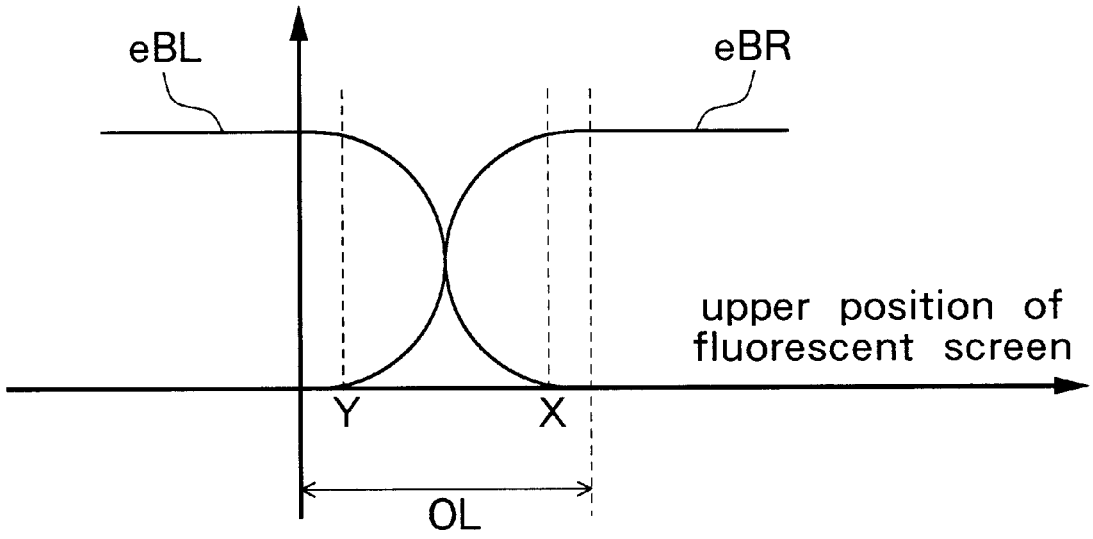
FIG. 5 is a characteristics diagram in a case where intensity distribution of each electron beam is changed like a sine function in an overlap area in the cathode ray tube shown in FIG. 2.

Since the connecting portion of the partial images in the overlapping area OL has to be made inconspicuous, as also described in the literature "The Camel CRT: ISSN0098-0966X/98/2901/1998-SID" announced by A.A.S.Sluyterman (Philips Components), it is considered to change the intensity distribution of each of the electron beams eBR and eBL. In the embodiment, as shown in FIG. 5, it is preferable to change the intensity distribution of each of the electron beams eBR and eBL almost like a sine function in the overlapping area OL so that the sum of the intensities of light excited and emitted by the electron beams becomes constant. For example, in a position X on the overlapping area OL on which the shadow 61L in FIG. 4 is cast, since the intensity of the electron beam eBL by which the shadow 61L is made is weak, the shadow 61L becomes light. Further, since the intensity of the electron beam eBR falling on the shadow 61L is strong, the shadow 61L becomes lighter even more. In a position Y on the overlapping area OL on which the shadow 61R in FIG. 3 is cast, the intensity of the electron beam eBR by which the shadow 61R is made is weak, the shadow 61R is light. Further, since the intensity of the electron beam eBL falling on the shadow 61R is strong, the shadow 61L becomes lighter even more.

As described above, in the embodiment, in the case where the electron beams eBR and eBL emitted from the electron beams 41R and 41L cross each other before passing through the aperture 23 in the color selecting member 22, the damper line 25 is provided in the area A in the aperture 23 in the color selecting member 22. Both of the electron beams eBR and eBL pass through the area A. On the shadow cast by one of the electron beams, the other electron beam falls, so that the shadow becomes lighter. Therefore, the damper line 25 of a larger diameter can be used and the vibration of the color selecting member 22 can be prevented under strong tension. As a result, even when the screen becomes larger by using the multiple electron gun type cathode ray tube, the cathode ray tube with a high quality image can be supplied. Further, by changing the intensity distribution of each of the electron beams eBR and eBL like a sine function in the overlapping area OL, a shadow of the damper line 25 can be made lighter and the vibration of the color selecting member 22 can be prevented with stronger tension.

[Second Embodiment]

Figure 6:
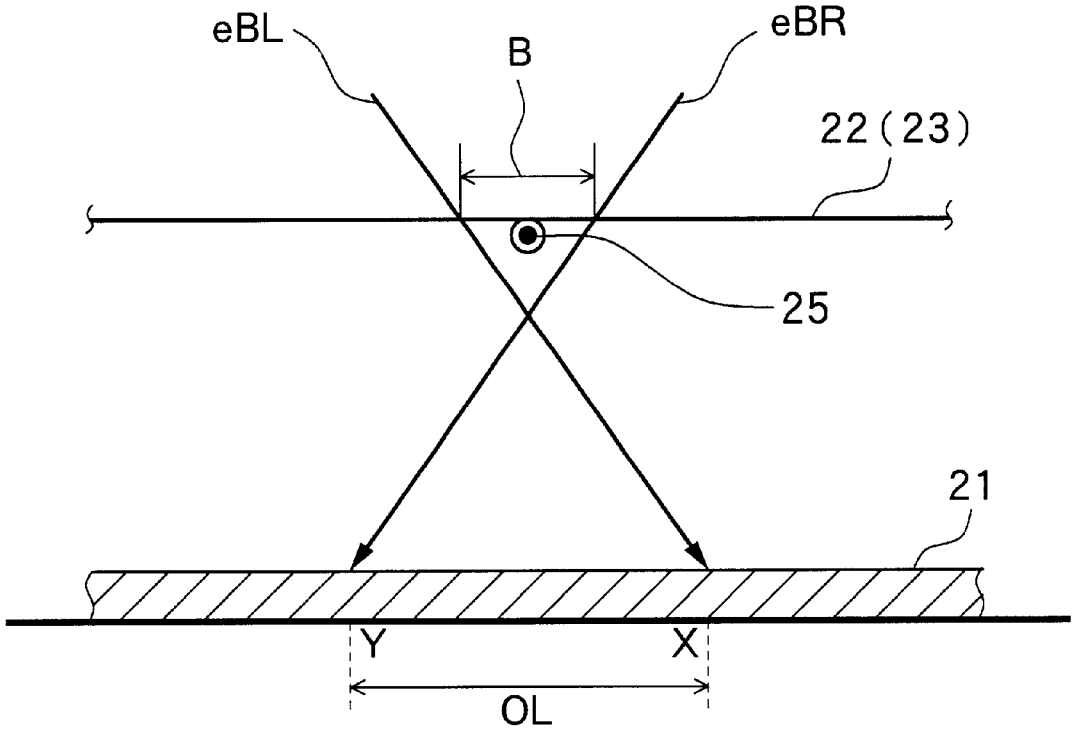
FIG. 6 is a diagram for explaining a setting position of the damper line in a case where each of electron beams cross each other after passing through an aperture in a color selecting member in a cathode ray tube having a color selecting member according to the second embodiment of the invention.

FIG. 6 shows a second embodiment of the invention and illustrates the setting position of the damper line 25 in the case where the electron beams eBR and eBL cross each other only after passing through the aperture 23 in the color selecting member 22, that is, the case an area where both of the electron beams eBR and eBL do not pass in the aperture 23 occurs in the color selecting member 22. Since the other configuration is similar to that of the first embodiment, the description is omitted here for simplification.

In the embodiment, the electron beam eBR from the electron gun 41R and the electron beam eBL from the electron gun 41L cross each other after passing through the aperture 23 in the color selecting member 22. Even when the line scan is performed, the electron beam eBL from the electron gun 41L does not pass through the area B in the aperture 23 in the color selecting member 22 and the electron beam eBR from the electron gun 41R does not pass through the area B in the aperture 23. That is, the area B is an area both of the electron beams eBR and eBL do not pass and in a position opposite to the overlapping area OL. In the embodiment, the damper line 25 is provided in the area B in the aperture 23.

When the damper line 25 is provided on the area B in the aperture 23, both the electron beams eBR and eBL do not hit the damper line 25, so that no shadow is cast.

As described above, according to the embodiment, when the damper line 25 is provided on the area B on which both the electron beams eBR and eBL do not fall, in the case where the respective electron beams eBR and eBL emitted from the electron guns 41R and 41L cross each other only after passing through the aperture 23 in the color selecting member 22, both of the electron beams eBR and eBL do not hit the damper line 25, so that no shadow is cast. Therefore, the damper line 25 of a larger diameter can be used, and the vibration of the color selecting member 22 can be prevented with stronger tension. Consequently, in spite of enlargement of the screen by using the multiple electron gun type cathode ray tube, the cathode ray tube of a high resolution can be provided.

As described above with the two embodiments, in the present invention, only by determining the setting position of the damper line 25 in the color selecting member 22 according to whether the electron beams eBR and eBL emitted from the neighboring electron guns 41R and 41L cross each other before or after passing through the aperture 23 in the color selecting member 22, a shadow of the damper line 25 cast on the video screen can be easily lightened or prevented. Further, the vibration of the color selecting member 22 can be effectively prevented.

The invention is not limited to the foregoing embodiments but can be variously modified. For example, although the cathode ray tube having two electron guns eBR and eBL has been described in the embodiments, the invention can be also applied to a multiple electron gun type cathode ray tube with three or more electron guns. In the embodiments, though the damper line 25 is a metal line, an insulating substance can be used as the material of the damper line 25.

Further, although the number of the damper line 25 is one in the embodiments, in order to prevent the vibration more effectively, a plurality of the damper lines 25 may be provided. In addition, although the diameter of the damper line 25 is set from about 20 to 22 $\mu$m in the embodiments, in order to prevent the vibration of the color selecting member 22 with stronger tension, the diameter may be increased. On the other hand, for example, in order to provide a plurality of damper lines 25, the diameter of the damper line 25 may be decreased.

Further, although the damper line 25 is stretched between the damper springs 55 attached to the pair of facing frame members 53, both ends of the damper line 25 may be fixed to the color selecting member 22 by welding or the like.

In the color selecting member according to the invention, since the damper line is provided in a tensioned state in a position opposite to the area on the fluorescent screen on which both of the electron beams emitted from the neighboring electron guns falls, a shadow of the damper line cast on the fluorescent screen can be lightened or prevented, and the vibration of the color selecting member can be effectively prevented.

Specifically, when the electron beams emitted from the electron guns cross each other before passing through an aperture in the color selecting member, the damper line is provided on an area in the aperture in the color selecting member, through which both of the electron beams pass. Consequently, on a shadow cast by one of the electron beams, the other electron beam falls, so that the shadow becomes lighter, the damper line of a larger diameter can be employed, and the vibration of the color selecting member can be prevented with stronger tension. When the electron beams emitted from the electron guns cross each other only after passing through the aperture in the color selecting member, the damper line is provided on the area in the aperture in the color selecting member, on which both of the electron beams do not fall. Consequently, both of the electron beams do not hit the damper line and no shadow is cast.

Further, according to the method of preventing vibration of the color selecting member according to the invention, only by determining the setting position of the damper line in the color selecting member according to whether electron beams emitted from a plurality of electron guns cross each other before or after passing through an aperture in the color selecting member, a shadow of the damper line cast on a video screen can be easily lightened or prevented. The vibration of the color selecting member can be also effectively prevented.

In addition, in the cathode ray tube according to the invention, by providing the color selecting member of the invention, a video image of high resolution can be displayed, even by enlarging the screen of the cathode ray tube of the multiple electron gun type.

Obviously many modifications and variations of the present invention are possible in the light of the above teachings. It is therefore to be understood that within the scope of the appended claims the invention may be practiced otherwise than as specifically described.

What is claimed is:

1. A color selecting member which is supported by a supporting member so as to face a fluorescent screen of a cathode ray tube and has a plurality of apertures through which a plurality of electron beams emitted from a plurality of electron guns pass to fall on the fluorescent screen, wherein in an area on the fluorescent screen, irradiated with both of the electron beams emitted from the neighboring electron guns, intensity of the electron beam emitted from one of the neighboring electron guns is changed like a sine function in correspondence with a position in the horizontal direction on the fluorescent screen and intensity of the electron beam emitted from the other electron gun is changed so that the sum of the intensities of the electron beams emitted from the neighboring electron guns becomes constant.

2. The color selecting member as set forth in claim 1, wherein said member is supported by a supporting member so as to face a fluorescent screen of a cathode ray tube and has a plurality of apertures through which a plurality of electron beams emitted from a plurality of electron guns pass to fall on the fluorescent screen, and is used for a cathode ray tube in which electron beams emitted from the neighboring electron guns cross each other after passing through the plurality of apertures, and a damper line for preventing vibration of the color selecting member is provided in an area through which both of the electron beams do not pass.

3. The color selecting member according to claim 1, wherein the apertures are arranged in stripes.

4. The color selecting member according to claim 1, wherein the member is used for a cathode ray tube wherein each electron beam emitted from neighboring electron guns cross each other before passing through the plurality of apertures, and a damper line for preventing vibration of the color selecting member is provided in an area where the electron beams from the plurality of electron guns pass.

5. A cathode ray tube comprising:

a plurality of electron guns;

a fluorescent screen which emits light by being irradiated with the electron beams emitted from the plurality of electron guns;

a color selecting member which has a plurality of apertures through which the electron beams pass to fall onto the fluorescent screen and is supported by a supporting member so as to face the fluorescent screen and so that electron beams emitted from the neighboring electron guns cross each other before passing through the plurality of apertures; and a damper line for preventing vibration which is provided e in an area in the color selecting member, through which both of the electron beams emitted from the neighboring electron guns pass.

6. A cathode ray tube comprising:

a plurality of electron guns;

a fluorescent screen which emits light by being irradiated with the electron beams emitted from the plurality of electron guns;

a color selecting member which has a plurality of apertures through which the electron beams pass to fall onto the fluorescent screen and is supported by a supporting member so as to face the fluorescent screen and so that electron beams emitted from the neighboring electron guns cross each other after passing through the plurality of apertures; and a damper line for preventing vibration which is provided in an area in the color selecting member, through which both of the electron beams emitted from the neighboring electron guns do not pass.

* * * * *

UNITED STATES PATENT AND TRADEMARK OFFICE

CERTIFICATE OF CORRECTION

PATENT NO. : 6,525,458 B1 
DATED : February 25, 2003
INVENTOR(S) : Shoichi Muraguchi et al.

It is certified that error appears in the above-identified patent and that said Letters Patent is hereby corrected as shown below:

Column 8,
Line 35, delete "e"

Signed and Sealed this

Fourteenth Day of October, 2003

JAMES E. ROGAN
*Director of the United States Patent and Trademark Office*